United States Patent [19]

Escamilla

[11] 3,988,957

[45] Nov. 2, 1976

[54] DRUM PEDAL ASSEMBLY

[75] Inventor: Gus Escamilla, Dallas, Tex.

[73] Assignee: The Raymond Lee Organization, Inc., New York, N.Y. ; a part interest

[22] Filed: Sept. 9, 1975

[21] Appl. No.: 611,832

[52] U.S. Cl. ..... 84/422 R
[51] Int. Cl.[2] ..... G10D 13/00
[58] Field of Search ..... 84/422

[56] References Cited

UNITED STATES PATENTS

| | | | |
|---|---|---|---|
| 2,484,302 | 10/1949 | Laverents | 84/422 |
| 2,785,596 | 3/1957 | Korosh | 84/422 |
| 2,845,830 | 8/1958 | Haviland | 84/422 |
| 3,677,128 | 7/1972 | Simpson | 84/422 |
| 3,750,517 | 8/1973 | Sleishman | 84/422 |

*Primary Examiner*—Stephen J. Tomsky
*Attorney, Agent, or Firm*—Howard I. Podell

[57] ABSTRACT

An assembly of two drum sticks rotatably mounted to a frame with a hinged foot pedal mounted about a pivot. The toe and heel section of the pedal are independently hinged together along the axis of the pivot mounting with one drumstick fastened by a first pivotable lever to the toe section and the other drumstick fastened by a second pivotable lever to the heel section of the pedal, so that the user can operate both drumsticks alternately using one foot on the foot pedal, when the assembly is mounted adjacent to, or clamped to a drum.

2 Claims, 3 Drawing Figures

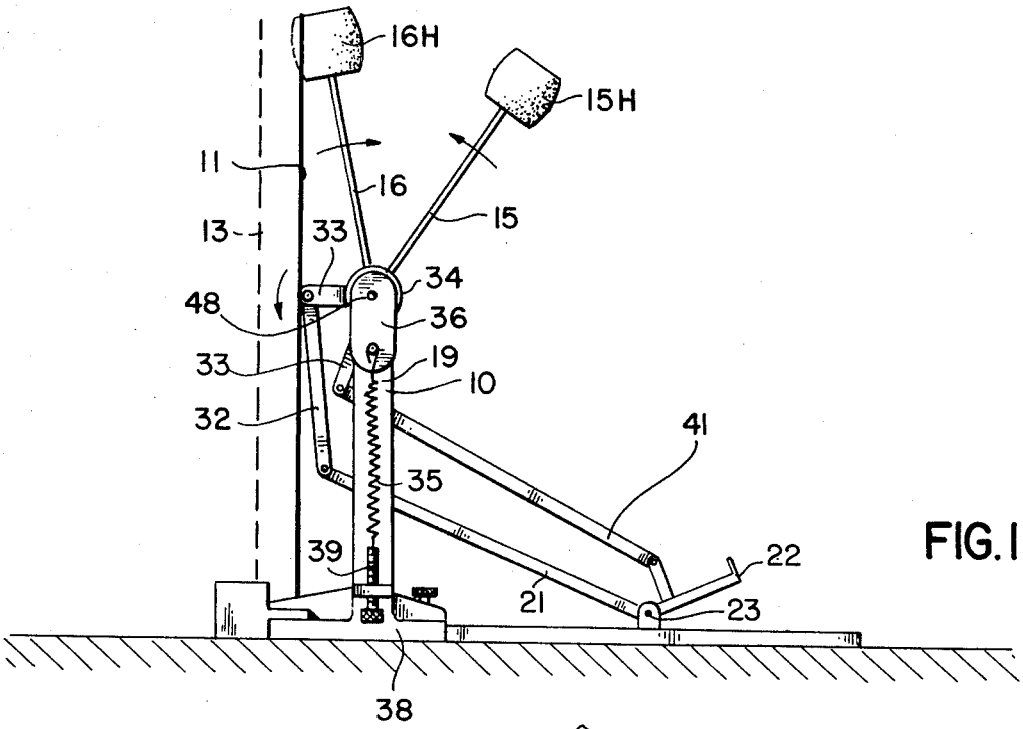
FIG. 1
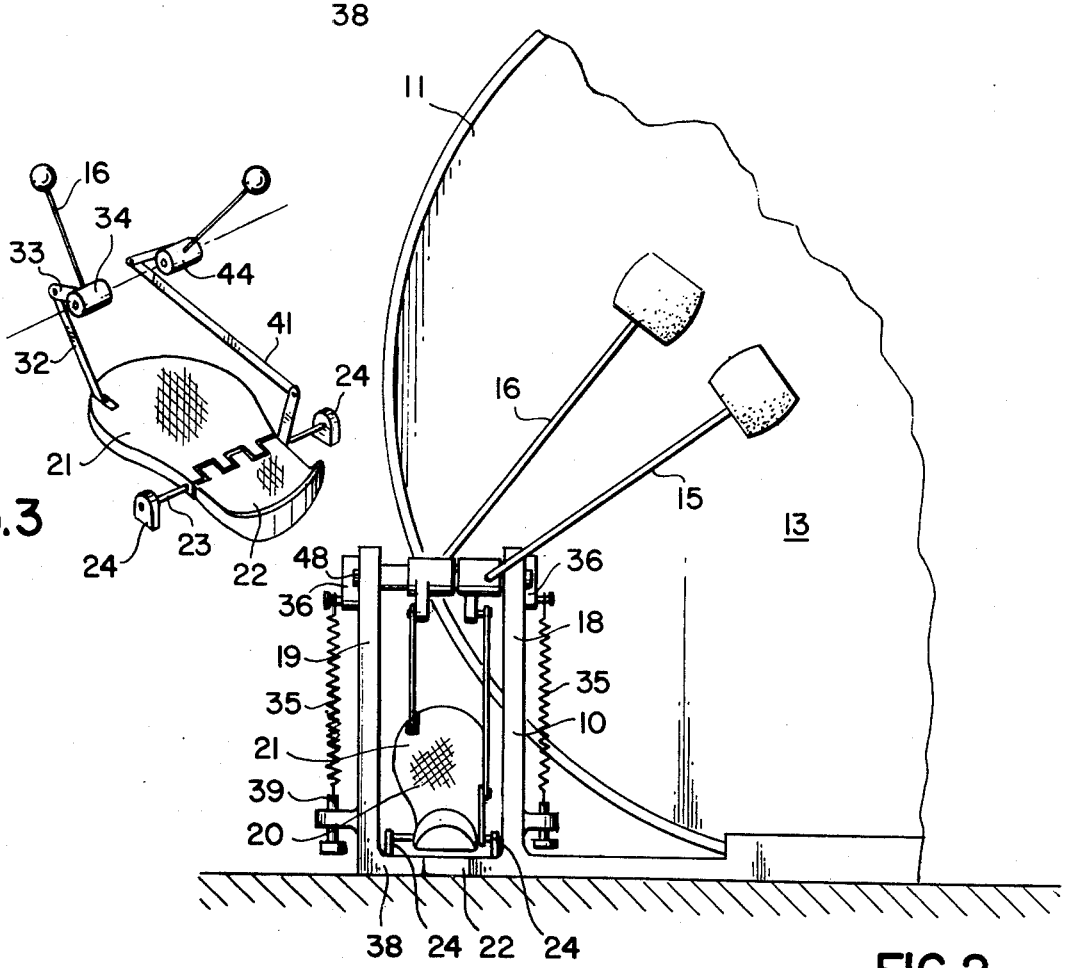
FIG. 3
FIG. 2

DRUM PEDAL ASSEMBLY

SUMMARY OF THE INVENTION

My invention is an assembly of two drumsticks rotatably mounted to a frame with a hinged foot pedal mounted about a pivot. The toe and heel section of the pedal are independently hinged together along the axis of the pivot mounting with one drumstick fastened by a first pivotable lever to the toe section and the other drumstick fastened by a second pivotable lever to the heel section of the pedal, so that the user can operate both drumsticks alternately using one foot on the foot pedal, when the assembly is mounted adjacent to, or clamped to a drum.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a side elevation view of the invention;

FIG. 2 is a front elevation view of the invention; and

FIG. 3 is a perspective schematic view of the pedal mounting.

DESCRIPTION OF THE PREFERRED EMBODIMENT

Turning now descriptively to the drawings, in which similar reference characters denote similar elements throughout the several views, FIGS. 1–3 illustrate the drum pedal assembly 10 which is mountable adjacent to or clamped to a bass drum 11 so that the user may hit the drum face 13 selectively with either one of two drumsticks 15 and 16 pivotably mounted by pin 48 to frame upright members 18 and 19, by depressing either the toe member 21 or the heel member 22 of a foot pedal 20.

Foot pedal 20 is formed of a toe member 21 and heel member 22 hinged together by pin 23 fixed to frame uprights 24 so that either toe or heel member 21 or 22 may independently rotate about pin 23.

Toe member 21 is pinned to rod 32 which is pinned to a rocker arm extension 33 radially mounted to the rotatable collar 34 to which the end of drumstick 16 is fastened. One end of a tension spring 35 is fixed to another radial rocker arm 36 also fastened to collar 34 so as to rotate collar 34 and drumstick 16 away from the plane of the drum face 13, with the other end of spring 35 fastened to the base section 38 of the frame by an adjustment screw 39.

Heel member 22 is similarly pinned to a bar 41 that is pinned to a radial rocker arm 43 mounted to the rotatable collar 44 to which drumstick 15 is fastened with a tension spring 35 fastened to a second rocker arm 36 and the base 38. Collars 44 and 34 are rotatably mounted on pin 48 fixed to frame upright members 18 and 19.

The user may alternately depress the toe pedal member 21 and the heel pedal member 22 to strike the drum face 13 with the drum heads 16H and 15H respectively, using only one foot of the user, with the other foot of the user free for other purposes.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A drum pedal assembly adaptable for mounting adjacent the face of a drum in which either of two drumsticks may be selectively employed to strike the drum face by the use of one pedal, comprising, a frame adaptable for mounting adjacent the face of a drum, two drumsticks each fixed to an individual collar rotatably mounted to the frame, a pedal formed of a toe member and a heel member joined together by rotatable hinge means to the frame, linkage means to join the toe pedal member to the periphery of the collar to which a first drumstick is fixed, linkage means to join the heel pedal member to the periphery of the collar to which the second drumstick is fixed and spring bias means to rotate the stick fastened to each collar away from the face of a drum adjacent the frame.

2. The combination as recited in claim 1 in which each spring means may be adjusted to adjust the bias force exerted on the attached drumstick collar.

* * * * *